United States Patent [19]

Lehmkuhl et al.

[11] Patent Number: 4,925,536

[45] Date of Patent: May 15, 1990

[54] PROCESSES FOR ADHESION-BONDING BETWEEN METALLIC MATERIALS AND GALVANIC ALUMINUM LAYERS AND NON-AQUEOUS ELECTROLYTES EMPLOYED THEREIN

[75] Inventors: Herbert Lehmkuhl; Klaus-Dieter Mehler, both of Mülheim/Ruhr, Fed. Rep. of Germany

[73] Assignee: Studiengesellschaft Kohle mbH, Mulheim/Ruhr, Fed. Rep. of Germany

[21] Appl. No.: 305,838

[22] Filed: Feb. 2, 1989

[30] Foreign Application Priority Data

Feb. 11, 1988 [DE] Fed. Rep. of Germany ..... 3804303

[51] Int. Cl.[5] ..... C25D 5/10

[52] U.S. Cl. ..... 204/58.5

[58] Field of Search ..... 204/58.5, 40

[56] References Cited

U.S. PATENT DOCUMENTS 4,721,656 1/1988 Vance ..... 204/58.5

OTHER PUBLICATIONS

Plating, Nov., 1972, pp. 1048–1052.

*Primary Examiner*—T. M. Tufariello

*Attorney, Agent, or Firm*—Sprung Horn Kramer & Woods

[57] ABSTRACT

Disclosed are electrolytes and processes for the metal-plating of metallic materials, and more specifically low-alloy high-strength steels, which processes are characterized in that adhesion-bonding layers of iron, iron and nickel, nickel, cobalt, copper or alloys of said metals or Sn-Ni alloys are electrodeposited on said metallic materials from non-aqueous electrolytes, and then aluminum is electrodeposited thereon in a per se known manner.

13 Claims, No Drawings

PROCESSES FOR ADHESION-BONDING BETWEEN METALLIC MATERIALS AND GALVANIC ALUMINUM LAYERS AND NON-AQUEOUS ELECTROLYTES EMPLOYED THEREIN

The invention relates to processes for the metal-plating or metallic materials, and more specifically low-alloy high-strength steels.

The invention further relates to the non-aqueous electrolytes employed within the procedures of the above processes.

Certain metals such as, for example, copper, may be directly electroplated with aluminum to form a firmly adhering layer thereon after appropriate mechanical and/or chemical pre-treatments for removing grease and/or oxide layers from the surface of the workpieces. On other metals such as, for example, iron materials and more particularly special steels, in general no firmly adhering layers of galvano-aluminum can be obtained in the same manner.

Thus, various procedures have been proposed for the preparation of workpieces made of electroconductive materials, more specifically of metals, in order to obtain a firmly adhering galvanic aluminum coating.

The German Patent Specification 22 60 191 (siemens AG; priority: Dec. 08, 1972) describes such a process which is characterized in that at least the last process step serving to shape the workpieces is carried out under an aprotic anhydrous and oxygen-free proctective medium. In the examples there have been mentioned as the last process steps of shaping miling, sawing or grinding the emery.

In the German Patent Publication 31 12 919 A1 (Siemens AG; priority: Mar. 31, 1981) there has been proposed to apply thin layers of cobalt or cobalt alloys from aqueous solutions to effect bonding on iron workpieces. Layer thicknesses of a maximum of 1 μm are said to be sufficient to effect bonding of aluminum to be subsequently applied by electroplating.

It was already previously recommended (H. Lehmkuhl, Dissertation, Technische Hochschule Aachen, 1954), to employ copper layers galvanically deposited from aqueous electrolytes to effect adhesion-bonding between iron workpieces and aluminum layers produced by electro-deposition.

It is a crucial drawback inherent to the two latter methods that in the electrodeposition from aqueous solutions of the metals serving as bonding agents a concomitant evolution of hydrogen cannot be avoided. However, low-alloy high-strength steels such as those set forth in Table 1 are very sensitive to embrittlement by hydrogen. Thus, aqueous electrolyte solutions are not suitable for electroplating those steels.

Thus, the invention relates to processes for the metal-plating of metallic materials, and more specifically low-alloy high-strength steels, which processes are characterized in that adhesion-bonding layers of iron, iron and nickel, nickel, cobalt, copper or alloys of said metals or tin-nickel alloys are deposited by electroplating from non-aqueous electrolytes and then aluminum is deposited thereon by electroplating in a per se known manner.

When said metals are employed as intermediate layers for subsequent galvanic alumino-plating, a layer thickness of from 1 to 4 μm is generally sufficient to ensure bonding between material, intermediate layer and electroplated aluminum layer.

In order to avoid the evolution of hydrogen and the danger associated therewith of an embrittlement of the materials, there are used, as the electrolytes, solutions of anhydrous metal salts of Fe, Co, Ni, Cu or Sn, and more specifically of the anhydrous halides and/or complex compounds of said metal halides with ethers such as, for example, tetrahydrofuran, or with alcohols such as, for example, ethanol, in water-free alkyl semi-ethers of a $C_2$- to $C_3$-alkylene glycol of the formula

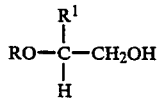

wherein

R represents $C_1$- to $C_6$-alkyl and phenyl, $R^1$ represents H or methyl, or mixtures of these solutions with the addition of anhydrous supporting electrolytes, and more specifically lithium chloride, lithium bromide or respective tetraorganylammonium halides.

Furthermore, as soluble anodes there are conveniently used those made of the respective metal or, in the case of the deposition of alloys, those made of the corresponding metals or appropriate alloy anodes.

In the case of Fe, Co, Ni and Sn compounds, the metal (II) compounds are expediently employed, while Cu(I) compounds are generally employed in the case of the deposition of Cu.

The use of 2-ethoxyethanol as solvent of electrolytes for the deposition of Cu, Ni, Co has been described by A. L. Chaney and C. A. Mann, J. Phys. Chem. 35 (1931) 2289. However, contrary to the process according to the invention, only the water-containing compounds {$Cu(ClO_4)_2 \cdot 2\ H_2O$, $Ni(ClO_4)_2 \cdot 2\ H_2O$ and $Co(ClO_4)_2 \cdot 2\ H_2O$}were described. The kind of metal deposition has been described by the authors as good for Cu, as less good, since brittle, for Ni, and also as less good for Co, because it was black and spongy. It is not known whether these layers are suitable as bonding layers for electroplated aluminum, while, however, this is subject to doubts in view of the properties of the Ni or Co layers such as brittleness and spongy nature. At all events, due to the proportions of water introduced by the metal salts, a formation of elemental hydrogen is still inevitable, so that the danger of an embrittlement by hydrogen of the materials remains existent.

The deposition described by A. J. Dill (Plating 1972, 59 (11), 1048–1052; Galvano-Organo 1974, 43, 151–156) of nickel from solutions of $NiCl_2 \cdot 6\ H_2O$ in ethylene glycol (1,2-ethanediol) also employs a water-containing salt as the starting material. Therefore, a concomitant hydrogen formation cannot be avoided. The same is applicable to the nickel deposition investigated by A. A. Sarabi and V. B. Singh, Indian J. of Technology 25 119 (1987) from 0.2M solutions of $NiCl_2$ of an undefined water content or of $NiSO_4 \cdot 7\ H_2O$ in 1,2-ethanediol or 2-methoxyethanol with the addition of boric acid (0.2M). In 2-methoxyethanol/$NiCl_2$/$H_3BO_3$/x $H_2O$ electrolytes the nickel deposits are uniform, grey-glossy and well-adhering at current densities of 0.1 to 0.3 $A/dm^2$, while at higher current densities they exhibit a tendency for becoming peeled off. Since the cathodic current yields amount to form only 90 to 98%, it must be assumed that hydrogen is concurrently formed. Hereto it has been generally known (F. A. Cotton and G. Wilkinson, Anorganische Chemie, Verlag Chemie, Weinheim 1967, p. 245), that boric acid with alcohols does very readily form boric esters by removal of water. With 1,2-alkanediols, such as 1,2-ethanediol, there are formed strongly acidic chelate complexes of the type

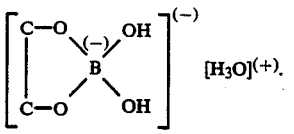

Both effects enhance the danger of a hydrogen elimination.

This danger does not exist in the process according to the invention, since here the anhydrous salts are employed and the solvent is also employed in the anhydrous condition and free from an addition of acid, and more particularly of boric acids. The anodic and cathodic current yields, based on dissolved or deposited metals, respectively, are quantitative. Hydrogen is not evolved. 1 Faraday, i.e. 26.8 ampere hours, will anodically dissolve 55.85/g of iron, 58.94/2 g of cobalt or 58.71/2 g of nickel in accordance with the electrolytic process $$M \rightarrow M^{2(+)} + 2\,e^{(-)}$$

and cathodically deposit the same amounts of metals according to $$M^{2(+)} + 2\,e^{(-)} \rightarrow M$$

In electrolyte solutions containing CuCl, 63.54 g of Cu will be dissolved per 1 Faraday according to $$M \rightarrow M^{(+)} + e^{(-)}$$

and the same amount of metal will be cathodically deposited according to $$M^{(+)} + e^{(-)} \rightarrow M$$

As the anhydrous metal salts, there are preferably used the anhydrous metal dichlorides or dibromides of Fe, Co and Ni and copper(I) chloride or bromide, respectively, or the addition compounds thereof with alcohols such as, for example, methanol or ethanol or with ethers such as, e.g., diethyl ether, THF or dimethoxyethane.

As the solvents there are employed alkyl semiethers of an alkylene glycol such as 1-alkoxy-2-hydroxyethane or 1-alkoxy-2-hydroxypropane, and more specifically the readily and inexpensively accessible semiethers of 1,2-ethanediol $ROCH_2CH_2OH$, preferably those wherein R=methyl, ethyl, propyl or isopropyl, or those of 1,2-propanediol, more particularly $CH_3CH(OH)\ CH_2OCH_3$.

The melat salt concentration in these solvents is recommended to be from 0.02 to 0.1M solutions, and preferably from 0.044 to 0.05M solutions. The concentration of the supporting electrolyte, more specifically of lithium bromide, should be of about the same or double the order of magnitude.

The electrolysis temperatures are between room temperature and about 120° C., temperatures between 50° C. and 80° C. being preferred. Good, homogeneous and glossy metal layers of Fe, Co, Ni or Cu may be obtained with current densities of between 0.2 and 1.5 A/dm$^2$, while 0.5 to 1.0 A/dm$^2$ are preferred (cf. Table 1).

If alloys are deposited, generally mixtures of solutions comprising the metal salts of the alloy constituents are employed according to the invention. Then, the anodes may be made of the respective alloys, or several electrodes of the metals of the individual alloy components may be employed. If a larger electrolyte stock is available, then it is possible to operate by using only an anode made of one of the alloy constituents. Then, the concentration of the other alloy constituent(s) must be periodically replenished by an addition of the respective salt. If the individual metal deposition tendencies are much different, then in the case of using alloy anodes there may also be used electrolytes which only contain the salt of the metal which is more difficult to deposit.

The composition of the alloy to be deposited may be varied within a wide range (cf. Table 2), that is (1) by changing the mutual ratio of the metal salts in the electrolyte and/or (2) by using several anodes having different active areas and made of the metals of the individual alloy constituents and/or (3) by employing several anodes made of the metals of the alloy constituents by means of different electric circuits between the cathode and the individual anodes.

In order to prevent an oxidation by air of the metal salt solutions and/or of the electrodeposited metal layers, the electrolyses are carried out in closed vessels in an inert gas atmosphere of, e.g., argon and/or laughing gas and/or nitrogen. Upon completion of the intermediate coating procedure, the workpieces are first washed with the electrolyte solvent. After draining the solvent off and drying in an inert gas stream or in vacuo, the workpieces are washed with dry toluene and then transferred into the aluminating bath via an inert gas lock. It is a particular advantage of such a mode of operation that no new oxide or water layer can be formed on the metal surface. Furthermore, subsequent expensive drying operations prior to the introduction into the aluminating bath are dispensable such as, for example, a treatment with fluorohydrocarbons containing wetting agents.

The invention is further illustrated by way of the examples described in the following two Tables.

EXAMPLE 1

As the electrolytic cell there is employed a cylindrical glass vessel with a surface-ground top edge which can be closely sealed by means of a lid made of an insulating material. Suspended on the lid is a cathode of the material to be coated, e.g. WL-1.6359, between two anode plates of the metal to be electrochemically dissolved, e.g. nickel. The electrode fixture means at the same time serve as current supply. The dry cell is filled with inert gas, e.g. argon or nitrogen. For coating the cathode with nickel, a solution comprising 0.05 moles of $NiCl_2 \cdot 0.63$ THF and 0.05 moles of LiBr in 1 liter of $CH_3OCH_2CH_2OH$ is employed as electrolyte. Electrolysis is conducted at 60° C. at a cathodic current density of 0.5 A/dm$^2$ at about 3 to 4 volt and with good mixing until a nickel layer of 1 $\mu$m in thickness has been deposited on the cathode. The anodic and cathodic current yields are quantitative, based on the amount of current.

Other metal depositions as set forth in Table 1 were carried out in the same manner using the electrolytes indicated in Table 1.

TABLE I

Adhesion-bonding of electroplated aluminum on iron materials through intermediate layers of Ni or Fe and Ni or Fe—Ni alloy (in all of the cases the quality of bonding between material and galvanized aluminum layer was very good - tested by tape test).

| Material[a] | Composition [%][c] | Bonding through | Electrolyte[b] |
|---|---|---|---|
| WL-1.6359 | 0.05–0.15 Al; 7.0–8.5 Co; 4.6–5.2 Mo; 17–19 Ni; 0.3–0.6 Ti | 1 μm of Ni | A |
| WL-1.6358 | 0.03 C; 5.3 Mo; 18.5 Ni; 9.0 Co; 0.6 Ti; 0.1 Al | 1 μm of Ni | A |
| | | or 3 μm of Sn—Ni alloy (4:1) | E |
| WL-1.7734 | 0.12–0.18 C; 0.8 –1.1 Mn; 1.25–1.5 Cr; 0.8–1.0 Mo; 0.2–0.3 V; 0–0.2 Si; | 1.5 μm of Fe | B |
| | | 3 μm of Ni | A |
| WL-1.7102 | 0.52–0.56 Cr; 1.4–1.7 Si; 0.6–0.8 Mn; 0.03 P; 0.05 S; 0.4–0.6 Cr; | 5 μm of Fe | B |
| | | 3 μm of Ni | A |
| WL-1.1248 | 0.7–0.8 C; 0.15–0.35 Si; 0.35 P; 0.35 S; 0.6–0.8 Mn | 5 μm of Fe | B |
| | | 3 μm of Ni | A |
| | | or 3–4 μm of Fe—Ni alloy (1:1) | C |
| WL-1.7176 | 0.52–0.59 C; 0.15–0.4 Si; 0.7–1.0 Mn; 0.035 P; 0.035 S; 0.6–0.9 Cr | 3 μm of Fe | B |
| | | 4 μm of Ni | A |
| | | or 3 μm of Fe—Ni alloy (1:1) | C |
| WL-1.8159 | 0.47–0.55 C; 0.4 Si; 0.7–1.1 Mn; 0.035 P; 0.03 S; 0.9–1.2 Cr; 0.1–0.2 V | 3 μm of Ni—Cu alloy (1:1–1:2) | D |

Notes to Table 1 see next page

Notes to Table 1

(a) Employed as cathode; anode consisted of the respective coating material. The electrolysis temperature was 60° C., the cathodic current density was 0.3 to 0.6 A/dm$^2$.

(b)

A: 0.05M $NiCl_2$.0.63 THF, 0.05M LiBr in $CH_3OCH_2CH_2OH$;

B: 0.05M $FeCl_2$ .1.25 THF, 0.05M LiBr in $CH_3OCH_2CH_2OH$;

C: 0.04M $NiCl_2$.0.63 THF, 0.01M $FeCl_2$.1.25 THF, 0.05M LiBr in $CH_3OCH_2CH_2OH$;

D: see Experiment No. 8, Table 2

E: see Experiment No. 7, Table 2.

(c) Balance Fe.

The classification of the materials is in conformity to "Werkstoffleistungsblatt, Handbuch der deutschen Luftfahrt" (WL) {see, e.g., "Edelstähle und Sonderwerkstoffe für die Luft- und Raumfahrt", Krupp Stahl AG, Brochure No.: 4400 (December 1982))}

EXAMPLE 2

This example in greater describes the experiment 1 listed in Table 2. A 0.05-molar (M) solution of LiBr in $CH_3OCH_2CH_2OH$ which in addition is 0.029M in $NiCl_2$ and 0.015 M in $FeCl_2$ is subjected to electrolysis at 65° C. in an inert gas atmosphere at a current density of 0.05 A/dm$^2$. Iron and nickel sheets are used as the anodes, the area ratio of the two metal anodes being 1.0:0.5. As the cathode there is employed a piece of the material WL-1.7176. The electrolysis is continued until an alloy layer of about 3 μm in thickness has been deposited on the cathode. The alloy consists of 75% of Fe and 25% of Ni. The experiments 2 through 9 were carried out in an analogous manner with the electrolytes and anodes specified in Table 2.

After the deposition of the intermediate coating according to the Examples 1 and 2 and the experiments summarized in the Tables 1 and 2 the workpieces were washed with the solvent of the electrolyte and dried in an inert gas stream. Then the workpieces are washed in dry toluene and transferred through an inert gas lock into the aluminating bath.

To obtain a quantitative measure for the adhesion strength of galvanically produced layers on materials, a method is employed which measures the force required to tear off the deposit from the substrate. The tape test is a quantitatively comparative method which in a simple manner allows to evaluate the adhesion. Therein, a strip of adhesive tape is first firmly pressed onto the galvano layer and then rapidly torn off. In the case of poor or moderate adhesion, the galvano layer will come off together with the adhesive tape strip from the material substrate. In the case of good adhesion, only small areas of the galvano layer will be removed, and in the case of very good adhesion the galvano layer remains completely intact on the substrate.

TABLE 2

Deposition of alloys for adhesion-bonding of electroplated aluminum

| Experiment Nr. | Metal salt concentration[a] [Molarity] | Anode (area ratio) | Current density [A/dm$^2$] | Composition of the alloy layer |
|---|---|---|---|---|

(A) Several anodes made of different metals

TABLE 2-continued

| Experiment Nr. | Metal salt concentration[a] [Molarity] | Anode (area ratio) | Current density [A/dm²] | Composition of the alloy layer |
|---|---|---|---|---|
| | Deposition of alloys for adhesion-bonding of electroplated aluminum | | | |
| | | having different areas | | |
| 1 | 0.029 $NiCl_2$<br>0.015 $FeCl_2$ | Ni:Fe<br>(1:0.5) | 0.5 | 75% Fe, 25% Ni |
| 2 | 0.037 $NiCl_2$<br>0.009 $FeCl_2$ | Ni:Fe<br>(1:0.21) | 0.5 | 55% Fe, 45% Ni |
| 3 | 0.037 $NiCl_2$[b]<br>0.009 $FeCl_2$ | Ni:Fe<br>(1:0.21) | 0.5 | 55% Fe, 45% Ni |
| 4 | 0.043 $NiCl_2$<br>0.005 $FeCl_2$ | Ni:Fe<br>(1:0.13) | 0.5 | 30% Fe, 70% Ni |
| 5 | 0.032 $NiCl_2$<br>0.018 $CoCl_2$ | Ni:Co<br>(1:0.58) | 0.5 | 47% Co, 53% Ni |
| 6 | 0.028 $NiCl_2$<br>0.005 $FeCl_2$<br>0.015 $CoCl_2$ | Ni:Co:Fe<br>(1:0.5:0.7) | 0.5 | 36% Fe, 25% Co, 39% Ni |
| 7 | 0.034 $NiCl_2$<br>0.016 $SnCl_2$ | Ni:Sn<br>(1:0.78) | 0.5 | 80% Sn, 20% Ni |
| | | (B) Alloy anode | | |
| 8 | 0.05 $NiCl_2$ | Ni/Cu<br><24:76> | 0.5 | 54% Cu, 46% Ni |
| 9 | 0.038 $NiCl_2$<br>0.013 $FeCl_2$ | Ni/Cu<br><24:76> | 0.5 | 29% Fe, 58% Cu, 13% Ni |

Notes to Table 2 see next page

Notes to Table 2

(a) Solvent: $CH_3OCH_2CH_2OH$; supporting electrolyte LiBr, 0.05M; electrolysis temperature 60° C.

(b) Similar results are obtained in $CH_3CH(OH)CH_2OCH_3$: 0.04M $NiCl_2$ - 0.01M $FeCl_2$; anode ratio Ni:Fe=1:0.24; 60° C. The same is applicable to $C_2H_5OCH_2CH_2OH$: 0.04M $NiCl_2$ - 0.01M $FeCl_2$; anode ratio Ni:Fe=1.0.24; 70° C. Alloy composition: 55% Ni, 45% Fe.

I claim:

1. A process for metal-plating of a metallic material, comprising electrodepositing on said metallic material from a non-aqueous electrolyte, an adhesion-bonding layer of iron, iron and nickel, nickel, cobalt, copper or an alloy of said metals or a tin-nickel alloy, and then electrodepositing aluminum thereon, the non-aqueous electrolyte containing an anhydrous supporting electrolyte and comprising a solution of an anhydrous metal salt of iron, cobalt, nickel, copper or tin in a water-free alkyl semi-ether of a $C_2$- to $C_3$-alkylene glycol of the formula

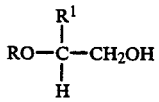

wherein

R represents $C_1$- to $C_6$-alkyl or phenyl, $R^1$ represents a hydrogen atom or a methyl group.

2. The process according to claim 1, wherein the metallic material is a low alloy high-strength steel.

3. The process according to claim 1, wherein the anhydrous metal salt is a chloride, bromide or complex thereof with an ether or alcohol, and the anhydrous supporting electrolyte comprises lithium chloride, lithium bromide or a tetraorganylammonium halide.

4. The process according to claim 1, wherein the non-aqueous electrolyte comprises a metal (II) compound of iron, cobalt, nickel or tin or a metal (I) compound of copper.

5. The process according to claim 1, wherein the electrodeposition is effected with a metal anode which has the same alloy composition as the metal cations of the metal salts of the electrolyte.

6. The process according to claim 1, wherein in the non-aqueous electrolyte the metal is present as a salt in a concentration of 0.02 to 0.1M.

7. The process according to claim 1, wherein in the non-aqueous electrolyte the metal is present as a salt in a concentration of 0.044 to 0.05M and lithium bromide is present in from 1 to 2 times the molar concentration of said metal salt.

8. The process according to claim 1, wherein the bonding layer is electrodeposited at a current density of from 0.2 to 1.5 A/dm² at a temperature from 20° to 120° C.

9. The process according to claim 1, wherein the bonding layer is electrodeposited at a current density of from 0.5 to 1 A/dm² at a temperature from 50° to 80° C.

10. The process according to claim 1, wherein the electrodeposition is effected in an inert gas atmosphere.

11. A non-aqueous electrolyte comprising non-aqueous solution of an anhydrous metal salt of iron, cobalt, nickel, copper or tin in a water-free alkyl semi-ether of a $C_2$- to $C_3$-alkylene glycol of the formula

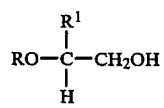

wherein

R represents $C_1$- to $C_6$-alkyl and phenyl, $R^1$ represents a hydrogen atom or a methyl group, containing an anhydrous supporting electrolyte.

12. A process for metal-plating of a metallic material, comprising electrodepositing on said metallic material from a non-aqueous electrolyte, an adhesion-bonding layer of iron, iron and nickel, nickel, cobalt, copper or an alloy of said metals or a tin-nickel alloy, and then electrodepositing aluminum thereon, the non-aqueous electrolyte comprising a $C_1$-$C_4$-alkyl semi-ether of an alkylene glycol.

13. The process according to claim 1, wherein the non-aqueous electrolyte comprises a $C_1$-$C_3$-alkyl semi-ether of 1,2-ethanediol or 1,2-propanediol.

* * * * *